US009771817B2

(12) United States Patent
Ruggiero et al.

(10) Patent No.: US 9,771,817 B2
(45) Date of Patent: Sep. 26, 2017

(54) METHODS AND SYSTEM FOR FLUIDIC SEALING IN GAS TURBINE ENGINES

(71) Applicant: General Electric Company, Schenectady, NY (US)

(72) Inventors: Eric John Ruggiero, West Chester, OH (US); Gregory Paul Rodebaugh, Clifton Park, NY (US); Rinaldo Luigi Miorini, Cohoes, NY (US)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 361 days.

(21) Appl. No.: 14/532,870

(22) Filed: Nov. 4, 2014

(65) Prior Publication Data

US 2016/0123168 A1 May 5, 2016

(51) Int. Cl.
*F01D 11/00* (2006.01)

(52) U.S. Cl.
CPC ..... *F01D 11/001* (2013.01); *F05D 2250/294* (2013.01)

(58) Field of Classification Search
CPC ..... F01D 25/12; F01D 11/001; F01D 11/02; F01D 11/025; F01D 11/04; F01D 11/06; F05D 2240/127
See application file for complete search history.

(56) References Cited

U.S. PATENT DOCUMENTS 5,639,095 A 6/1997 Rhode
6,276,692 B1 * 8/2001 Beeck ..... F01D 11/04 277/411
7,465,152 B2 * 12/2008 Nigmatulin ..... F01D 5/20 415/170.1
7,946,808 B2 * 5/2011 Taylor ..... F01D 11/001 415/173.7
8,016,552 B2 9/2011 Bunker
2012/0163955 A1 * 6/2012 Devi ..... F01D 11/02 415/1
2014/0196433 A1 7/2014 Kaufman et al.
2014/0234076 A1 8/2014 Lee et al.

FOREIGN PATENT DOCUMENTS

EP 626036 B1 10/1996

OTHER PUBLICATIONS

Laskowski, G.M., "An investigation of turbine wheel space cooling flow interactions with a transonic hot gas path—Part 2: CFD simulation," Proceedings of the ASME Turbo Expo, vol. 3, Issue Part B, 2009, pp. 1095-1111.

* cited by examiner

*Primary Examiner* — Dwayne J White
*Assistant Examiner* — Peter T Hrubiec
(74) *Attorney, Agent, or Firm* — John P. Darling

(57) ABSTRACT

A sealing system for a rotatable element defining an axis of rotation includes a rotor blade including a shank and an angel wing extending axially from the shank. The sealing system also includes a stator vane positioned axially adjacent the rotor blade. The stator vane includes a platform extending in an axial direction over the angel wing such that a clearance gap is defined therebetween. The sealing system also includes a sealing mechanism including a portion of the platform and a portion of the angel wing. The sealing mechanism includes at least one obliquely oriented surface such that the clearance gap defines a converging nozzle.

17 Claims, 6 Drawing Sheets

METHODS AND SYSTEM FOR FLUIDIC SEALING IN GAS TURBINE ENGINES

BACKGROUND

This invention relates generally to turbomachines. More specifically, the invention is directed to methods and apparatus for impeding the flow of gas (e.g., hot gas) through selected regions of stator-rotor assemblies in turbomachines, such as turbine engines.

In operation of at least some known turbine engines, intake air is channeled towards a compressor where it is compressed to higher pressures and temperatures prior to being discharged towards a combustor section. The compressed air is channeled to a fuel nozzle assembly, mixed with fuel, and burned within each combustor to generate combustion gases that are channeled downstream through a rotor/stator cavity of a turbine section. The combustion gases impinge upon rotor blades positioned within the turbine to convert thermal energy into mechanical rotational energy that is used to drive a rotor assembly. The turbine section drives the compressor section and/or a load, via separate drive shafts, and discharges exhaust gases to the ambient atmosphere.

At least some known gas turbine engines define a wheelspace radially inward of the rotor/stator cavity that includes components fabricated from materials having a temperature resistance that is lower than temperatures present in the rotor/stator cavity. Furthermore, at least some known rotor blades include a shank, and a connecting structure coupled to the shank, such as a dovetail, used to couple a rotor blade to a rotor wheel. An airfoil is also coupled to the shank such that the airfoil is exposed to the hot combustion gases.

In at least some known rotor blade constructions, structures commonly referred to as "angel wings," extend axially fore and/or aft from the shank. In at least some known gas turbine engines, at least one angel wing extends from an upstream-facing shank wall and/or a downstream-facing shank wall of a rotor blade and under-hangs a platform portion of an adjacent stator to define a substantially constant gap therebetween. The stator platform and rotor angel wing combine to at least partially prevent channeling of hot combustion gases into a buffer cavity defined radially inward of the angel wing. Reducing the amount of hot combustion gas channeled into the wheelspace is desirable to prevent reducing the operational lifetime of wheelspace components due to exposure to the hot combustion gases.

In at least some known gas turbine engines, cooling air is channeled under pressure into the inner wheelspace to facilitate reducing an amount of hot combustion gas channeled into the inner wheelspace. However, the channeling of cooling air into the inner wheelspace may have the effect of reducing engine efficiency. Furthermore, the size of the gap defined between the stator platform and the angel wing must accommodate transient events in the engine due to rotation of the rotor and expansion of certain turbine components due to heat. The gap is large enough to provide a path which can allow hot combustion gases into the wheelspace and, therefore, requires an amount of the cooling air that may negatively affect engine efficiency.

BRIEF DESCRIPTION

In one aspect, a sealing system for a rotatable element defining an axis of rotation is provided. The sealing system includes a rotor blade including a shank and an angel wing extending axially from the shank. The sealing system also includes a stator vane positioned axially adjacent the rotor blade. The stator vane includes a platform extending in an axial direction over the angel wing such that a clearance gap is defined therebetween. The sealing system also includes a sealing mechanism including a portion of the platform and a portion of the angel wing. The sealing mechanism includes at least one obliquely oriented surface such that the clearance gap defines a converging nozzle.

In another aspect, a method of assembling a sealing system having a rotatable element that defines an axis of rotation is provided. The method includes providing a rotor blade that includes a shank and an angel wing extending axially from the shank and coupling a stator vane axially adjacent the rotor blade. The stator vane includes a platform extending in an axial direction over the angel wing such that a clearance gap is defined therebetween. The method also includes obliquely orienting a surface of at least one of the platform and the angel wing such that the clearance gap defines a converging nozzle.

In another aspect, a rotatable element defining an axis of rotation is provided. The rotatable element includes an outer chamber configured to channel a flow of a combustion gas and an inner chamber configured to channel a flow of a heat transfer medium. The rotatable element also includes a sealing system configured to channel the flow of heat transfer medium such that the flow of combustion gas is isolated from the inner chamber. The sealing system includes a rotor blade including a shank and an angel wing extending axially from the shank. The sealing system also includes a stator vane positioned axially adjacent the rotor blade. The stator vane includes a platform extending in an axial direction over the angel wing such that a clearance gap is defined therebetween. The sealing system also includes a sealing mechanism including a portion of the platform and a portion of the angel wing. The sealing mechanism includes at least one obliquely oriented surface such that the clearance gap defines a converging nozzle.

DRAWINGS

These and other features, aspects, and advantages of the present disclosure will become better understood when the following detailed description is read with reference to the accompanying drawings in which like characters represent like parts throughout the drawings, wherein.

Figure 4:
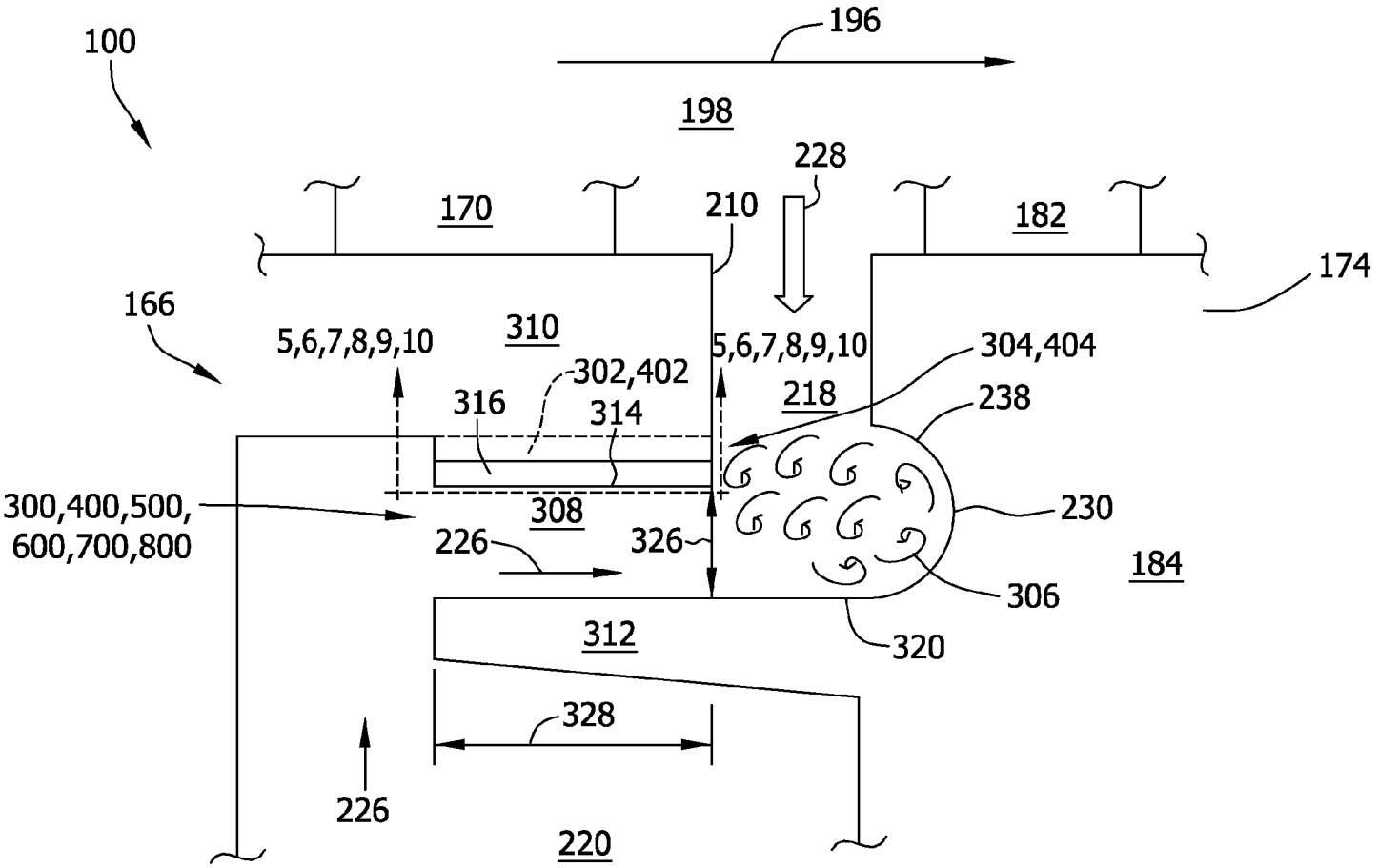
FIG. 4 is an enlarged side schematic side sectional view of a portion of the gas turbine engine illustrated in FIG. 2 illustrating an alternative sealing system that defines a plurality of circumferentially-spaced grooves.
Figures 7, 8, 9, 10:
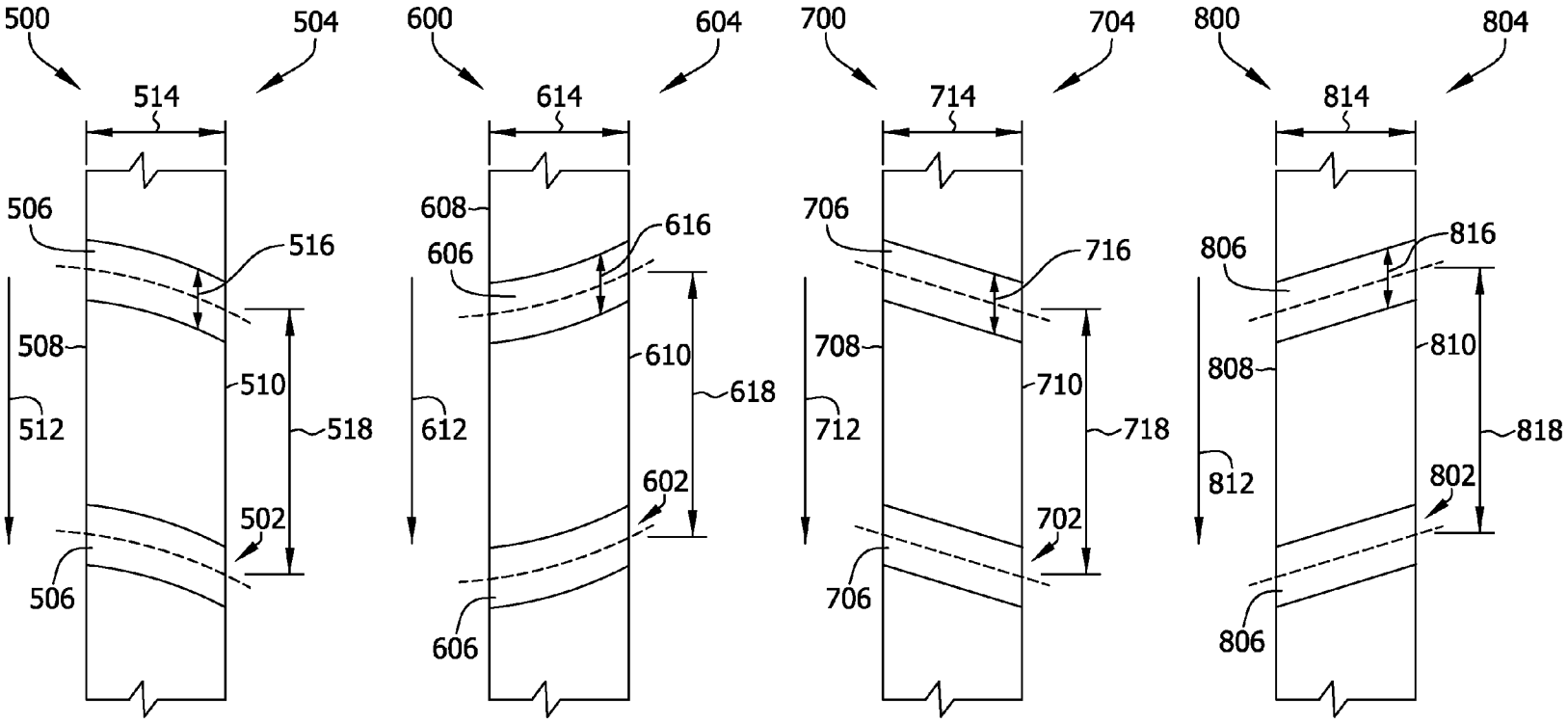

FIG. 7 is a bottom view of the sealing system shown in FIG. 4, and taken along line 7-7, defining a plurality of curved grooves FIG. 8 is a bottom view of the sealing system shown in FIG. 4, and taken along line 8-8, defining a plurality of curved grooves FIG. 9 is a bottom view of the sealing system shown in FIG. 4, and taken along line 9-9, defining a plurality of obliquely oriented grooves FIG. 10 is a bottom view of the sealing system shown in FIG. 4, and taken along line 10-10, defining a plurality of obliquely oriented grooves Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged; such ranges are identified and include all the sub-ranges contained therein unless context or language indicates otherwise.

As used herein, the terms "axial" and "axially" refer to directions and orientations extending substantially parallel to a longitudinal axis of a gas turbine engine. Moreover, the terms "radial" and "radially" refer to directions and orientations extending substantially perpendicular to the longitudinal axis of the gas turbine engine.

The sealing systems described herein facilitate efficient methods of sealing a turbomachine. Specifically, in contrast to many known sealing systems, the sealing systems as described herein generate vortices in a cooling flow that form a fluidized curtain of air that substantially reduce an amount of hot combustion gases channeled into a rotor wheelspace from a hot gas path. More specifically, a sealing mechanism includes a portion of a stator platform, a portion of a rotor angel wing, and the clearance gap defined therebetween. In one embodiment, at least one of the radially inner surface of the platform and the radially outer surface of the angel wing is obliquely oriented such that the clearance gap forms a converging nozzle. The nozzle accelerates a cooling flow and creates vortices proximate the nozzle outlet to substantially reduce an amount of hot combustion gases channeled therethrough. In another embodiment, a plurality of circumferentially-spaced grooves are formed in the stator platform to create disturbances in a shear layer that generates vortices to reduce an amount of hot combustion gases channeled therethrough. In one embodiment, the grooves are each axially oriented, and in another embodiment, the grooves are angled with respect to an axis of rotation such that the grooves form a chevron pattern. The sealing systems described herein include a sealing mechanism that utilizes less bleed air from the compressor to create a more effective fluidic seal than known configurations to increase the efficiency of the engine.

Figure 1:
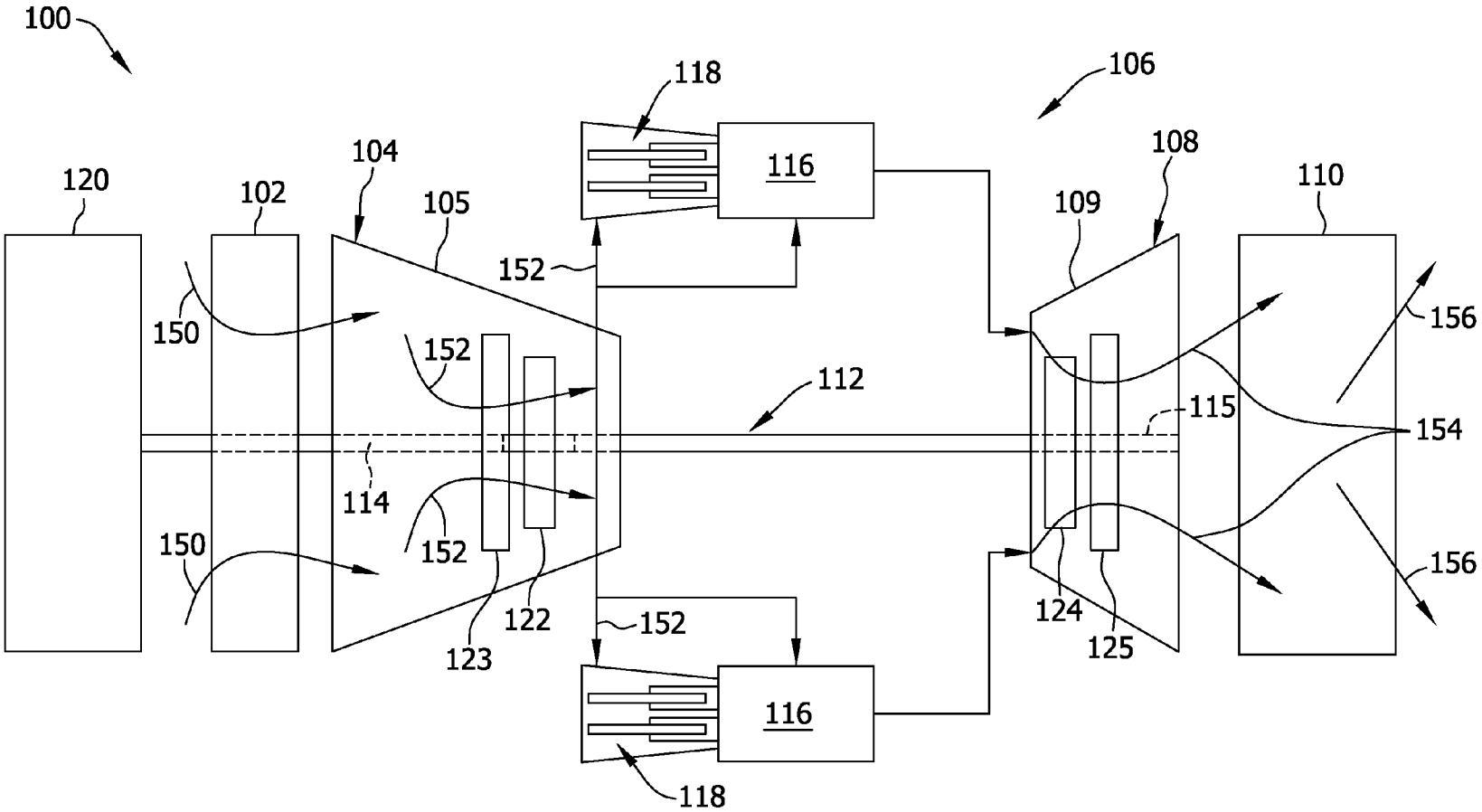
FIG. 1 is a schematic illustration of a gas turbine engine.

FIG. 1 is a schematic view of an exemplary rotary machine 100, i.e., a turbomachine, and more specifically, a turbine engine. In the exemplary embodiment, turbine engine 100 is a gas turbine engine. Alternatively, turbine engine 100 is any other turbine engine and/or rotary machine, including, without limitation, a steam turbine engine, and is not limited to the turbine shown in FIG. 1. In the exemplary embodiment, gas turbine engine 100 includes an air intake section 102, and a compressor section 104 that is downstream from, and in flow communication with, intake section 102. Compressor section 104 is enclosed within a compressor casing 105. A combustor section 106 is coupled downstream from, and in flow communication with, compressor section 104, and a turbine section 108 is coupled downstream from, and in flow communication with, combustor section 106. Turbine engine 100 is enclosed within a turbine casing 109 and includes an exhaust section 110 that is downstream from turbine section 108. Moreover, in the exemplary embodiment, turbine section 108 is coupled to compressor section 104 via a rotor assembly 112 that includes, without limitation, a compressor rotor, or drive shaft 114 and a turbine rotor, or drive shaft 115.

In the exemplary embodiment, combustor section 106 includes a plurality of combustor assemblies, i.e., combustors 116 that are each coupled in flow communication with compressor section 104. Combustor section 106 also includes at least one fuel nozzle assembly 118. Each combustor 116 is in flow communication with at least one fuel nozzle assembly 118. Moreover, in the exemplary embodiment, turbine section 108 and compressor section 104 are rotatably coupled to a load 120 via drive shaft 114. For example, load 120 includes, without limitation, an electrical generator and/or a mechanical drive application, e.g., a pump. Alternatively, gas turbine engine 100 is an aircraft engine. In the exemplary embodiment, compressor section 104 includes at least one compressor blade assembly 122, i.e., blade 122 and at least one adjacent stationary vane assembly 123.

Also, in the exemplary embodiment, turbine section 108 includes at least one stationary stator assembly 124 and at least one adjacent turbine blade assembly, i.e., a rotor blade 124, also referred to a bucket. Each compressor blade assembly 122 and each turbine rotor blade 125 is coupled to rotor assembly 112, or, more specifically, compressor drive shaft 114 and turbine drive shaft 115, respectively.

In operation, air intake section 102 channels air 150 towards compressor section 104. Compressor section 104 compresses inlet air 150 to higher pressures and temperatures prior to discharging at least a portion of compressed air 152 towards combustor section 106. Compressed air 152 is channeled to fuel nozzle assembly 118, mixed with fuel (not shown), and burned within each combustor 116 to generate combustion gases 154 that are channeled downstream towards turbine section 108. After impinging turbine rotor blade 125, thermal energy from gases 154 themselves and kinetic energy from gases 154 impinging blades 125 are converted into mechanical energy that is used to drive rotor assembly 112. Turbine section 108 drives compressor section 104 and/or load 120 via drive shafts 114 and 115, and exhaust gases 156 are discharged through exhaust section 110 to ambient atmosphere.

Figure 2:
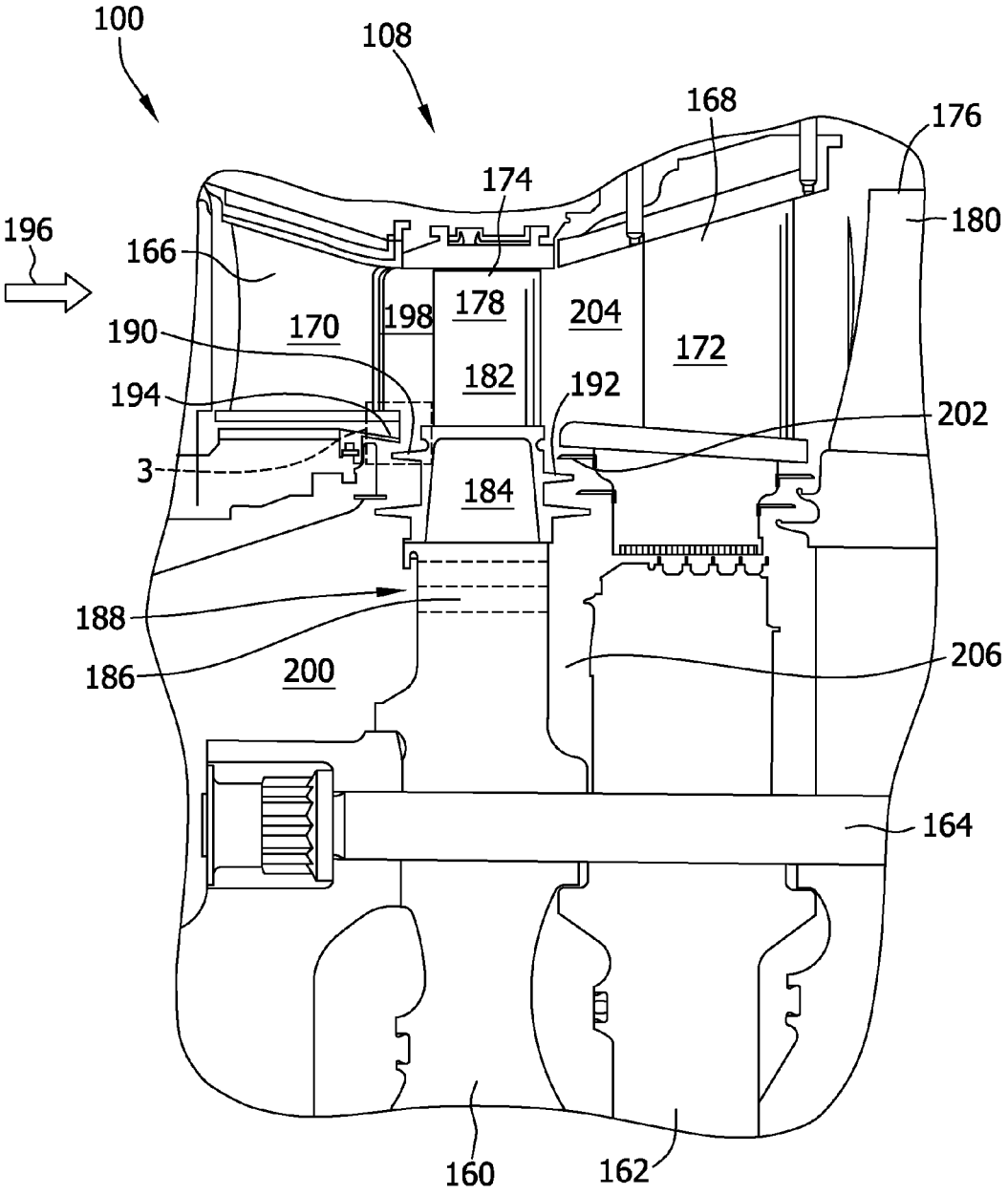
FIG. 2 is an enlarged schematic side sectional view of a portion of the gas turbine engine illustrated in FIG. 1.

FIG. 2 is an enlarged schematic illustration of a portion of turbine section 108 that includes axially spaced-apart rotor wheels 160 and spacers 162 that are coupled to each other, for example, by a plurality of circumferentially spaced, axially-extending bolts 164. Although bolts 164 are shown in FIG. 2, for facilitating coupling of wheels 160 to spacers 162, any other suitable coupling structures may be used that enable gas turbine engine 100 to function as described herein. Gas turbine engine 100 includes, for example, a first stator stage 166 and a second stator stage 168. Each of stator stages 166 and 168 includes a plurality of circumferentially spaced stator vanes, such as stator vanes 170 and 172. Similarly, gas turbine engine 100 also includes a first rotor stage 174 and a second rotor stage 176. Each of rotor stages 174 and 176 includes a plurality of circumferentially spaced rotor blades, such as rotor blades 178 and 180. First rotor stage 174 is coupled to turbine drive shaft 115, for rotation between stator stages 166 and 168. Similarly, second rotor stage 176 likewise is coupled to turbine drive shaft 115, for rotation between second-stage stators 168 and a third stage of stators (not shown). Although only two rotor stages 174 and 176 and two stator stages 166 and 168 are shown and described herein, at least some known gas turbine engines include different numbers of stator and rotor blade stages.

Each rotor blade 178 is coupled to rotor wheel 160 using any suitable coupling method that enables gas turbine engine 100 to function as described herein. For example, each rotor blade 178 includes an airfoil 182, a shank 184, and a dovetail 186 that is insertably received axially within a similarly-shaped slot 188 in rotor wheel 160. Each rotor blade 178 further includes a plurality of angel wings 190 and 192 that extend axially forward and aft, respectively, from shank 184. Although only two angel wings 190 and 192 are shown in FIG. 2, rotor blade 178 includes any number of angel wings sufficient to enable it to function as described herein.

Angel wing 190 cooperates with a stator platform 194 of stator vane 170 to facilitate substantially reducing hot combustion gases 196 from being channeled from an outer rotor/stator cavity 198 defining hot gas path 196, into an inner wheelspace 200. Similarly, angel wing 192 cooperates with an aft stator platform 202, respectively, to facilitate substantially reducing hot combustion gases 196 from being channeled from an outer rotor/stator cavity 204 into an inner wheelspace 206. In some embodiments, similar cooperating sets of angel wings and stator platforms or other structures are provided for each rotor wheel stage and adjacent nozzle stage of gas turbine engine 100. In alternative embodiments, cooperating sets of angel wings and stator platforms or other structures are provided at only rotor wheel stage 174 and adjacent nozzle stage 166 of gas turbine engine 100, or at only some (but not all) of the rotor wheel stages 176 and adjacent nozzle stages 168 of gas turbine engine 100.

Figure 3:
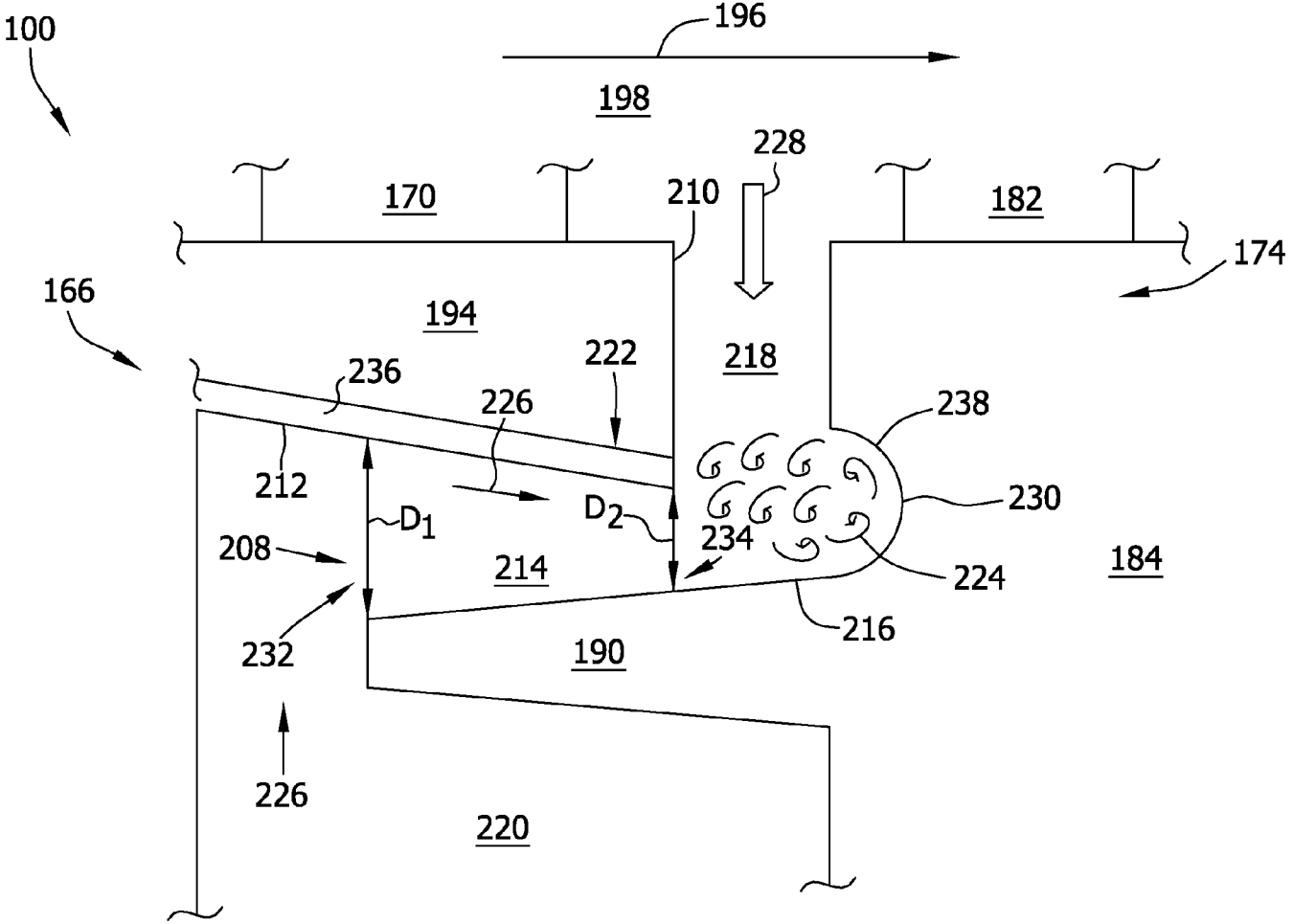
FIG. 3 is an enlarged side schematic side sectional view of a portion of the gas turbine engine illustrated in FIG. 2 illustrating an exemplary sealing system that defines a converging nozzle.

FIG. 3 illustrates an enlarged sectional view of a portion of gas turbine engine 100 in which an exemplary sealing system 208 is used for sealing hot gas path 196 from wheelspace 200. FIG. 3 illustrates the general region of gas turbine engine 100 featuring first stage stator 166 and first stage rotor 174. Stator vane 170 includes platform 194, i.e., a protruding portion of nozzle 166 structure which is shaped to function as part of a gas flow restriction scheme, as described above. Platform 194 includes an aft surface 210 and a radially inner surface 212. Platform 194 extends in an axial direction at least partially over angel wing 190 such that an axially-oriented clearance gap 214 is defined between radially outer platform 194 and radially inner angel wing 190. More specifically, clearance gap 214 is defined between radially inner surface 212 of platform 194 and an opposing radially outer surface 216 of angel wing 190. Rotor shank 184 and stator platform 194 also define a radially-oriented trench cavity 218 therebetween that is in flow communication with hot gas path 198 and clearance gap 214. Similarly, rotor shank 184 and stator stage 166 define a radially-oriented purge cavity 220 that is in flow communication with wheelspace 200 (shown in FIG. 2) and clearance gap 214.

In the exemplary embodiment, sealing system 208 includes a sealing mechanism 222 that includes a portion of platform 194 and a portion of angel wing 190. Sealing mechanism 222 is configured to generate vortices 224 in a cooling flow 226 being channeled through clearance gap 214 such that vortices 224 isolate trench cavity 218 from purge cavity 220 and wheelspace 200. More specifically, vortices 224 formed by sealing mechanism 222 substantially reduce portion 228 of hot combustion gases 196 from cavity 198 from being channeled into purge cavity 220. Generally, vortices 224 are formed by cooling flow 226 flowing through clearance gap 214 and impinging on a cutback groove 230 defined in shank 184, as described in further detail below.

In the exemplary embodiment, sealing mechanism 222 includes an obliquely oriented surface that defines a converging nozzle between radially inner surface 212 of platform 194 and radially outer surface 216 of angel wing 190. More specifically, in one embodiment, radially inner surface 212 is obliquely oriented with respect to drive shaft 115 (shown in FIG. 1) such that clearance gap 214 defines an inlet 232 having a first radial distance D1 and an outlet 234 having a second radial distance D2 that is shorter than first distance D1. In the exemplary embodiment, radially inner surface 212 of platform 194 is oblique and radially outer surface 216 of angel wing 190 is substantially parallel to shaft 115. In another embodiment, radially outer surface 216 is oriented obliquely and radially inner surface 212 is substantially parallel to shaft 115. In yet another embodiment, and as shown in FIG. 3, both radially inner and radially outer surfaces 212 and 216 are oriented obliquely to define clearance gap 214 as a converging nozzle.

In one embodiment, sealing system 208 also includes a layer of sealing material 236 applied to platform 194 such that radially inner surface 212 is the radially inner surface of sealing material 236. In such an embodiment, sealing material 236 is one of an abradable material or a honeycomb material. Alternatively, sealing material 236 is any sealing material that enables operation of sealing system 208 as described herein. As discussed above, during operation of engine 100, rotor stage 174 rotates about rotor shaft 115 and angel wing 190 may rub against platform 194. As such, sealing material 236 protects platform 194 and angel wing 190 from experiencing a reduction in expected surface life during engine 100 operation. In the exemplary embodiment, sealing material 236 is applied or coupled to platform 194 such that clearance gap 214 retains a converging nozzle shape despite rubs between platform 194 and angel wing 190. Furthermore, in one embodiment, sealing material 236 is applied to platform 194 such that clearance gap 214 defines the convergent nozzle shape. In another embodiment, sealing material 236 is applied or coupled to platform 194 such that clearance gap 214 defines the convergent nozzle shape only after a predetermined number of revolutions of rotor stage 174.

In operation, as is shown in FIG. 3, hot combustion gas 196 is directed along cavity 198 through turbine section 108 (shown in FIG. 1) and flows aftward through first stator stage 166 and first rotor stage 174, continuing through other stator-rotor assemblies in engine 100. As the hot gas stream 196 flows over trench cavity 218, a portion 228 of the hot gases 196 enter trench cavity 218 and flow toward purge cavity 220 and wheelspace 200. As described above, coolant flow 226 is usually bled from compressor 104 (shown in FIG. 1) and directed from wheelspace 200 into purge cavity 220, to counteract the leakage 228 of hot gas 196. As cooling flow 226 flows through inlet 232 of clearance gap 214, the converging nozzle shape of clearance gap 214 accelerates cooling flow 226 through smaller outlet 234 such that cooling flow 226 impinges on an arcuate surface 238 of cutback groove 230, which is positioned adjacent to clearance gap outlet 234. After impingement, cooling flow 226 forms plurality of vortices 224 that combine to form a fluidized curtain of cooling air that, in combination with a circumferential shear layer caused by rotation of rotor stage 174, minimize the amount of hot gas that is channeled into purge cavity 220. Additionally, should any hot gases of portion 228 pass through vortices 224, the force of cooling flow 226 exiting converging clearance gap 214 substantially reduces an amount of hot gas 196 from portion 228 from entering clearance gap 214.

FIG. 4 illustrates an enlarged sectional view of a portion of gas turbine engine 100 in which an alternative sealing system 240/300. Sealing system 300 is substantially similar to sealing system 208 in operation and composition, with the exception that sealing system 300 includes a plurality of circumferentially-spaced grooves 302 rather than at least one obliquely oriented surface 212 (shown in FIG. 3) that forms a converging nozzle, as described above. As such, like components of sealing system 300 in FIG. 4 are numbered with like reference numerals of sealing system 208 in FIG. 3.

In the exemplary embodiment, sealing system 300 includes a sealing mechanism 304 that includes a portion of platform 310 and a portion of angel wing 312. Sealing mechanism 304 is configured to generate vortices 306 in cooling flow 226 being channeled through a clearance gap 308 defined between a stator platform 310 and a rotor angel wing 312. Vortices 306 isolate trench cavity 218 from purge cavity 220 and wheelspace 200. More specifically, vortices 306 formed by sealing mechanism 304 substantially reduce a portion 228 of hot gas 196 from cavity 198 from being channeled into purge cavity 220. Generally, vortices 306 are formed by cooling flow 226 flowing through clearance gap 308 and impinging on cutback groove 230 formed in shank 184, as described in further detail below. Alternatively, sealing system 300 may not include cutback groove 230.

In the exemplary embodiment, grooves 302 are machined into a radially inner surface 314 of platform 310 to facilitate generating vortices 306 within a shear layer formed within clearance gap 306. More specifically, the shear layer is a circumferentially oriented layer of cooling flow 226 air formed at least partially by a velocity gradient defined between the circumferentially rotating angel wing 312 and an overlapping portion of stationary platform 310. Accordingly, grooves 302 in platform 310 cause a disturbance in the shear layer of cooling flow 226 that promotes formation of vortices 306 that interfere with channeling of portion 228 of hot gas 196 and increase the effectiveness of sealing system 300.

In one embodiment, sealing system 300 also includes a layer of sealing material 316 applied to platform 310 such that radially inner surface 314 is the radially inner surface of sealing material 316. In such an embodiment, sealing material 316 is one of an abradable material or a honeycomb material. Alternatively, sealing material 316 is any sealing material that enables operation of sealing system 300 as described herein. As discussed above, during operation of engine 100, rotor stage 174 rotates about rotor shaft 115 and angel wing 312 may rub against platform 310. As such, sealing material 316 protects platform 310 and angel wing 312 from experiencing a reduction in the expected service life during engine 100 operation.

Figure 5:
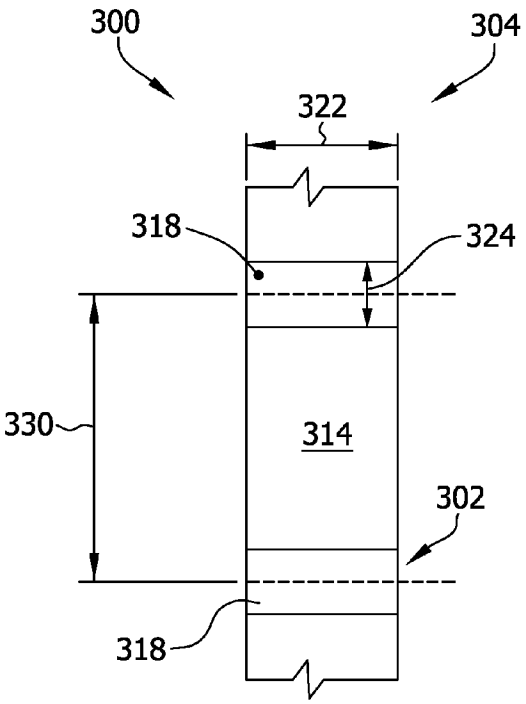
FIG. 5 is a bottom view of the sealing system shown in FIG. 4, and taken along line 5-5, defining a plurality of axially oriented grooves.

FIG. 5 is a bottom view of sealing system 300, taken along line 5-5 (shown in FIG. 4) illustrating plurality of grooves 302. In the exemplary embodiment, plurality of circumferentially-spaced grooves 302 includes a plurality of axially oriented grooves 318 formed in radially inner surface 314 of platform 310. More specifically, grooves 318 are formed in platform 310 such that clearance gap 308 (shown in FIG. 4) is defined between grooves 318 and a radially outer surface 320 (shown in FIG. 4) of angel wing 312. Each of grooves 318 is oriented substantially axially with respect to shaft 115 (shown in FIG. 1) and an axis of rotation of engine 100. Each of grooves 318 includes a length 322 and a circumferential width 324 that are based on a radial depth 326 and an axial length 328 (both shown in FIG. 4) of clearance gap 308. Furthermore, a midpoint of each groove 318 is spaced a distance 330 from a midpoint of an adjacent groove 318 such that the plurality of grooves 302 are evenly circumferentially-spaced about platform 310.

Figure 6:
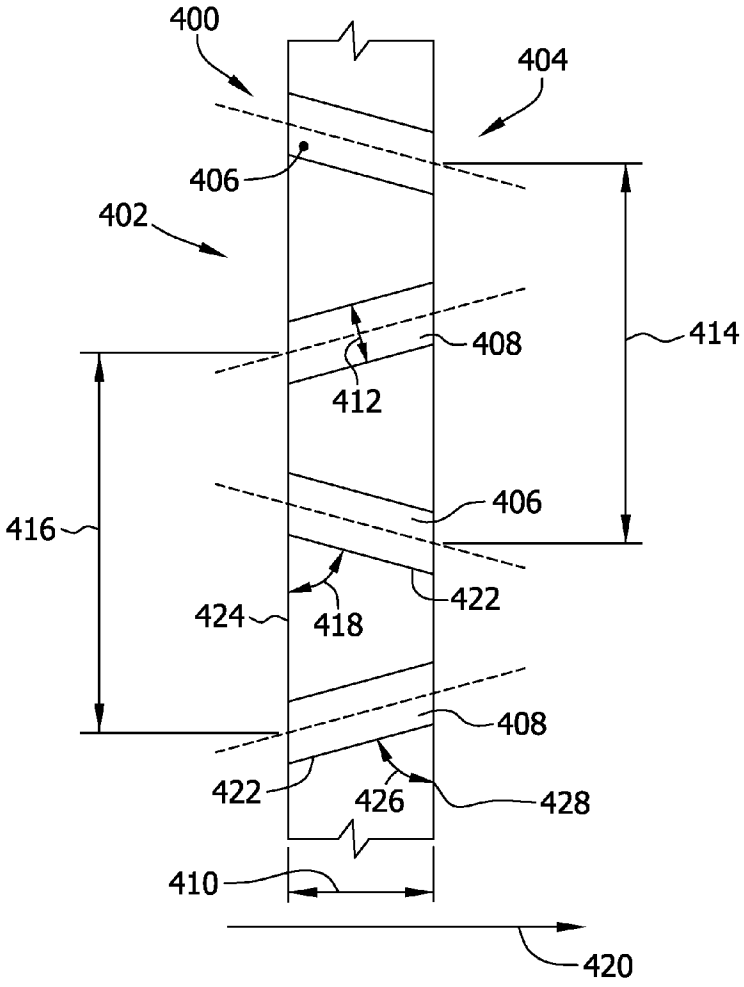
FIG. 6 is a bottom view of the sealing system shown in FIG. 4, and taken along line 6-6, defining a plurality of skewed grooves.

FIG. 6 is a bottom view of an alternative sealing system 400, taken along line 6-6 (shown in FIG. 4) illustrating plurality of circumferentially-spaced grooves 402 of a sealing mechanism 404. Sealing system 400 is substantially similar to sealing system 300 in operation and composition, with the exception that sealing system 400 includes a first plurality of grooves 406 and a second plurality of grooves 408, where sealing system 300 included a single plurality of grooves 302. In one embodiment, plurality of circumferentially-spaced grooves 402 includes a first plurality of grooves 406 and a second plurality of grooves 408. Grooves 406 and 408 are formed in radially inner surface 314 of platform 310 (both shown in FIG. 4). More specifically, grooves 406 and 408 are formed in platform 310 such that clearance gap 308 is defined between sealing mechanism 404 having grooves 406 and 408 and radially outer surface 320 of angel wing 312. Each of grooves 406 and 408 includes a length 410 and a circumferential width 412 that are based on radial depth 326 and axial length 328 (both shown in FIG. 4) of clearance gap 308. Furthermore, a midpoint of each groove 406 is spaced a distance 414 from a midpoint of an adjacent groove 406. Similarly, a midpoint of each groove 408 is spaced a distance 416 from a midpoint of an adjacent groove 408. In the exemplary embodiment, distances 414 and 416 are substantially similar. Alternatively, distances 414 and 416 may be different from one another.

In the embodiment shown in FIG. 6, first and second pluralities of grooves 406 and 408 alternate such that each groove 406 is positioned between circumferentially immediately adjacent grooves 408. Similarly, each groove 408 is positioned between circumferentially immediately adjacent grooves 406. Furthermore, each of first plurality of grooves 406 is oriented at a first angle 418 with respect to an axis of rotation 420. First angle 418 is defined between a first edge 422 of groove 406 and a first edge 424 of sealing mechanism 404. Similarly, each of second plurality of grooves 408 is oriented at a second angle 426 with respect to axis of rotation 420. Second angle 426 is defined between first edge 422 of groove 408 and a second edge 428 of sealing mechanism 404. First and second angles 418 and 426 are substantially similar to each other such that first and second pluralities of grooves 406 and 408 define a chevron pattern of grooves 402 in radially inner surface 314 of platform 310.

In operation, hot combustion gas 196 is directed along cavity 198 (both shown in FIG. 4) through turbine section 108 (shown in FIG. 1) and flows aftward through first stator stage 166 and first rotor stage 174, continuing through other stator-rotor assemblies in engine 100 (shown in FIG. 1). As hot gas stream 196 flows over trench cavity 218, a portion 228 (both shown in FIG. 4) of hot gases 196 enter trench cavity 218 and flow toward purge cavity 220 and wheelspace 200. As described above, coolant flow 226 (shown in FIG. 4) is bled from compressor 104 (shown in FIG. 1) and directed from wheelspace 200 (shown in FIG. 2) into purge cavity 220 (shown in FIG. 4), to counteract the leakage 228 of hot gas 196. Angles 418 and 426 of grooves 406 and 408, respectively, force cooling flow 226 to follow a longer path through clearance gap 308. Because grooves 406 and 408 are skewed with respect to axis 420, cooling flow 226 has a velocity component that is not parallel to axis 420, and, therefore, creates a disturbance in cooling flow 226 that forms vortices 306. More specifically, cooling flow 226 exits alternating grooves 406 and 408 at two different angles 418 and 426 such that cooling flow 226 downstream of clearance gap 308 is scrambled to generate vortices 306. Vortices 306 form a fluidized curtain of cooling air that, in combination with a circumferential shear layer caused by rotation of rotor stage 174, minimize the amount of hot gas 196 that is channeled into purge cavity 220.

FIG. 7 is a bottom view of an alternative sealing system 500, taken along line 7-7 (shown in FIG. 4) illustrating a plurality of circumferentially-spaced grooves 502 of a sealing mechanism 504. Sealing system 500 is substantially similar to sealing system 300 in operation and composition, with the exception that sealing system 500 includes a plurality of grooves 506 that are each curved, where sealing system 300 includes a plurality of axially-oriented grooves 302.

As shown in FIG. 7, sealing mechanism 504 includes a first edge 508 and an opposing second edge 510. Each of grooves 506 is curved between edges 508 and 510 in a direction oriented substantially towards a direction of rotation 512 of stator stage 166 (shown in FIG. 4). Each of grooves 506 includes an axial length 514 defined between edges 508 and 510 and a substantially constant circumferential width 516. Length 514 and width 516 are based on radial depth 326 and axial length 328 of clearance gap 308 (all shown in FIG. 4). Furthermore, a midpoint of each groove 506 is spaced a distance 518 from a midpoint of an adjacent groove 506.

FIG. 8 is a bottom view of an alternative sealing system 600, taken along line 8-8 (shown in FIG. 4) illustrating a plurality of circumferentially-spaced grooves 602 of a sealing mechanism 604. Sealing system 600 is substantially similar to sealing system 500 in operation and composition, with the exception that sealing system 600 includes a plurality of grooves 606 that are curved against a direction of rotation of stator stage 166 (shown in FIG. 4), where sealing system 500 includes a plurality of grooves 502 curved in the rotation direction.

As shown in FIG. 8, sealing mechanism 604 includes a first edge 608 and an opposing second edge 610. Each of grooves 606 is curved between edges 608 and 610 in a direction oriented substantially against a direction of rotation 612 of stator stage 166. Each of grooves 606 includes an axial length 614 defined between edges 608 and 610 and a substantially constant circumferential width 616. Length 614 and width 616 are based on radial depth 326 and axial length 328 of clearance gap 308 (all shown in FIG. 4). Furthermore, a midpoint of each groove 606 is spaced a distance 618 from a midpoint of an adjacent groove 606.

FIG. 9 is a bottom view of an alternative sealing system 700, taken along line 9-9 (shown in FIG. 4) illustrating a plurality of circumferentially-spaced grooves 702 of a sealing mechanism 704. Sealing system 700 is substantially similar to sealing system 300 in operation and composition, with the exception that sealing system 700 includes a plurality of grooves 706 that are each oriented obliquely, where sealing system 300 includes a plurality of axially-oriented grooves 302.

As shown in FIG. 9, sealing mechanism 704 includes a first edge 708 and an opposing second edge 710. Each of grooves 706 obliquely extends between edges 708 and 710 in a direction oriented substantially towards a direction of rotation 712 of stator stage 166 (shown in FIG. 4). Grooves 706 may be oriented at angle with respect to rotational direction 712. Each of grooves 706 includes an axial length 714 defined between edges 708 and 710 and a substantially constant circumferential width 716. Length 714 and width 716 are based on radial depth 326 and axial length 328 of clearance gap 308 (all shown in FIG. 4). Furthermore, a midpoint of each groove 706 is spaced a distance 718 from a midpoint of an adjacent groove 706.

FIG. 10 is a bottom view of an alternative sealing system 800, taken along line 10-10 (shown in FIG. 4) illustrating a plurality of circumferentially-spaced grooves 802 of a sealing mechanism 504. Sealing system 800 is substantially similar to sealing system 700 in operation and composition, with the exception that sealing system 800 includes a plurality of grooves 806 that are each oriented against a rotational direction, where sealing system 700 includes a plurality of grooves 706 oriented in the rotational direction.

As shown in FIG. 10, sealing mechanism 804 includes a first edge 808 and an opposing second edge 810. Each of grooves 806 obliquely extends between edges 808 and 810 in a direction oriented substantially against a direction of rotation 812 of stator stage 166 (shown in FIG. 4). Grooves 806 may be oriented at angle with respect to rotational direction 812. Each of grooves 806 includes an axial length 814 defined between edges 808 and 810 and a substantially constant circumferential width 816. Length 814 and width 816 are based on radial depth 326 and axial length 328 of clearance gap 308 (all shown in FIG. 4). Furthermore, a midpoint of each groove 806 is spaced a distance 818 from a midpoint of an adjacent groove 806.

The sealing systems described herein facilitate efficient methods of sealing a turbomachine. Specifically, in contrast to many known sealing systems, the sealing systems as described herein generate vortices in a cooling flow that form a fluidized curtain of air that substantially reduces an amount of hot combustion gases from being channeled into the rotor wheelspace. More specifically, a sealing mechanism includes a portion of a stator platform, a portion of a rotor angel wing, and the clearance gap defined therebetween. In one embodiment, at least one of the radially inner surface of the platform and the radially outer surface of the angel wing is obliquely oriented such that the clearance gap forms a converging nozzle. The nozzle accelerates a cooling flow and creates vortices proximate the nozzle outlet to reduce the amount of hot combustion gases channeled therethrough. In another embodiment, a plurality of circumferentially-spaced grooves are formed in the stator platform to create disturbances in a shear layer that generates vortices to reduce the amount of hot combustion gases channeled therethrough. In one embodiment, the grooves are each axially oriented, and in another embodiment, the grooves are angled with respect to an axis of rotation such that the grooves form a chevron pattern. The sealing systems described herein include a sealing mechanism that utilizes less bleed air from the compressor to create a more effective fluidic seal than known configurations to increase the efficiency of the engine.

An exemplary technical effect of the methods, systems, and apparatus described herein includes at least one of: (a) minimizing an amount of hot combustion gas channeled into the rotor wheelspace such that the hot gas is prevented from reaching rotor components not designed to withstand high temperatures; and (b) increasing the efficiency of the engine by introducing less cooling air to the hot gas path.

Exemplary embodiments of methods, systems, and apparatus for fluidic sealing of a clearance gap defined between a stator platform and a rotor blade angel wing are not limited to the specific embodiments described herein, but rather, components of systems and steps of the methods may be utilized independently and separately from other components and steps described herein. For example, the methods may also be used in combination with other sealing systems to seal a component, and are not limited to practice with only the fluidic systems and methods as described herein. Rather, the exemplary embodiment can be implemented and utilized in connection with many other applications, equipment, and systems that may benefit from creating vortices in a flow to form a fluidic seal.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A sealing system for a rotatable element, the rotatable element defining an axis of rotation, said sealing system comprising:

a rotor blade comprising a shank and an angel wing extending axially from said shank;

a stator vane positioned axially adjacent said rotor blade, said stator vane comprising a platform extending in an axial direction over said angel wing such that a clearance gap is defined therebetween; and a sealing mechanism comprising a portion of said platform and a portion of said angel wing, said platform having a radially inner surface and said angel wing having radially outer surface, wherein the radially inner surface and the radially outer surface are obliquely oriented with respect to each other to define a clearance gap therebetween such that said clearance gap defines a converging nozzle, wherein said clearance gap defines an inlet further defining a first radial distance and an outlet further defining a second radial distance that is shorter than the first distance, and wherein the inlet is positioned proximate a distal end of said angel wing, and wherein the outlet is positioned proximate a distal end of said platform.

2. The sealing system in accordance with claim 1, wherein the rotatable element includes an outer chamber configured to channel a flow of a combustion gas and an inner chamber configured to channel a flow of a heat transfer medium, wherein said sealing mechanism is configured to generate vortices in the heat transfer medium to isolate the flow of combustion gas from the inner chamber.

3. The sealing system in accordance with claim 1, wherein said obliquely oriented surface comprises a radially inner surface of said portion of said platform.

4. The sealing system in accordance with claim 1, wherein said obliquely oriented surface comprises a radially outer surface of said portion of said angel wing.

5. The sealing system in accordance with claim 1, wherein said rotor blade comprises a cutback groove defined in said shank and positioned adjacent the outlet such that a heat transfer medium flows through the clearance gap and impinges on the cutback groove, thereby generating a plurality of vortices in the heat transfer medium to facilitate isolating a trench cavity from a purge cavity.

6. The sealing system in accordance with claim 1 further comprising one of an abradable seal and a honeycomb seal coupled to said obliquely oriented surface.

7. The sealing system in accordance with claim 1, wherein said at least one obliquely oriented surface comprises a radially inner surface of said portion of said platform and a radially outer surface of said portion of said angel wing.

8. A method of assembling a sealing system having a rotatable element that defines an axis of rotation, said method comprising:

providing a rotor blade that includes a shank and an angel wing extending axially from the shank;

coupling a stator vane axially adjacent the rotor blade, the stator vane including a platform extending in an axial direction over the angel wing; and obliquely orienting a surface of at least one of the platform and the angel wing with respect to each other to define a clearance gap therebetween such that the clearance gap defines a converging nozzle, wherein said clearance gap defines an inlet further defining a first radial distance and an outlet further defining a second radial distance that is shorter than the first distance, and wherein the inlet is positioned proximate a distal end of said angel wing, and wherein the outlet is positioned proximate a distal end of said platform.

9. The method in accordance with claim 8, wherein the radially inner surface of the platform is obliquely oriented with respect to the axis of rotation.

10. The method in accordance with claim 8, wherein the radially outer surface of the angel wing is obliquely oriented with respect to the axis of rotation.

11. The method in accordance with claim 8, wherein the radially inner surface of the platform is obliquely oriented with respect to the axis of rotation and wherein the radially outer surface of the angel wing is obliquely oriented with respect to the axis of rotation.

12. The method in accordance with claim 8, wherein the converging nozzle accelerates a heat transfer medium to isolate a radially outer flow of combustion gas from a radially inner wheelspace.

13. The method in accordance with claim 8 further comprising forming a cutback groove defined in said shank and proximate an outlet of the clearance gap such that a heat transfer medium flows through the clearance gap and impinges on the cutback groove, thereby generating a plurality of vortices in the heat transfer medium.

14. The method in accordance with claim 8 further comprising applying a sealing material to at least one of the platform and the angel wing.

15. A rotatable element defining an axis of rotation, said rotatable element comprising:

an outer chamber configured to channel a flow of a combustion gas;

an inner chamber configured to channel a flow of a heat transfer medium; and a sealing system configured to channel the flow of heat transfer medium such that the flow of combustion gas is isolated from the inner chamber, wherein said sealing system comprises:

a rotor blade comprising a shank and an angel wing extending axially from said shank;

a stator vane positioned axially adjacent said rotor blade, said stator vane comprising a platform extending in an axial direction over said angel wing such that a clearance gap is defined therebetween; and a sealing mechanism comprising a portion of said platform and a portion of said angel wing, said platform having a radially inner surface and said angel wing having radially outer surface, wherein the radially inner surface and the radially outer surface are obliquely oriented with respect to each other to define a clearance gap therebetween such that said clearance gap defines a converging nozzle, wherein said clearance gap defines an inlet further defining a first radial distance and an outlet further defining a second radial distance that is shorter than the first distance, and wherein the inlet is positioned proximate a distal end of said angel wing, and wherein the outlet is positioned proximate a distal end of said platform.

16. The rotatable element in accordance with claim 15, wherein the at least one of a radially inner surface of said portion of said platform and the radially outer surface of said portion of said angel wing is obliquely oriented with respect to the axis of rotation.

17. The rotatable element in accordance with claim 15, wherein said rotor blade comprises a cutback groove defined in said shank and positioned adjacent the outlet such that a heat transfer medium flows through the clearance gap and impinges on the cutback groove, thereby generating a plurality of vortices in the heat transfer medium to facilitate isolating a trench cavity from a purge cavity.

* * * * *